United States Patent [19]

Going, III

[11] Patent Number: 4,579,177

[45] Date of Patent: Apr. 1, 1986

[54] SUBSURFACE SOLENOID LATCHED SAFETY VALVE

[75] Inventor: Walter S. Going, III, Houston, Tex.

[73] Assignee: Camco, Incorporated, Houston, Tex.

[21] Appl. No.: 702,295

[22] Filed: Feb. 15, 1985

[51] Int. Cl.[4] ..... E21B 34/00; E21B 34/06

[52] U.S. Cl. ..... 166/332; 166/66.5; 166/66.4; 251/129.21; 137/629

[58] Field of Search ..... 166/66.4, 66.5, 65.1, 166/332; 251/129.21, 89; 137/629; 335/220, 255, 229

[56] References Cited

U.S. PATENT DOCUMENTS

| | | | |
|---|---|---|---|
| Re. 30,110 | 10/1970 | Huebsch et al. | 166/65 M |
| 3,731,742 | 5/1973 | Sizer et al. | 166/72 X |
| 3,999,574 | 12/1976 | Ott | 137/629 |
| 4,002,202 | 1/1977 | Huebsch et al. | 166/66.4 |
| 4,161,215 | 7/1979 | Bourne, Jr. et al. | 166/332 X |
| 4,191,248 | 3/1980 | Huebsch et al. | 166/65 M |

*Primary Examiner*—Stephen J. Novosad
*Assistant Examiner*—David J. Bagnell
*Attorney, Agent, or Firm*—Fulbright & Jaworski

[57] ABSTRACT

A subsurface solenoid well safety valve which is locked in the open position, after being opened mechanically, for preventing the valve from closing. A valve closure member is controlled by a tubular member which is mechanically moved downwardly to open the valve. An armature movable in the housing is actuated by a solenoid coil for locking the tubular member in the open position to the valve housing. Deenergization of the coil releases the armature and the lock and allows the tubular member to be biased to the open position.

6 Claims, 4 Drawing Figures

10
12
17
22
32
36
38
39
40
42
44
46
50
52
54
60
62
26
30

26
28
22
20
24
18
18
22

32

46
12
50
44
42
36
22
39
60
62
38
40
52
54

SUBSURFACE SOLENOID LATCHED SAFETY VALVE

BACKGROUND OF THE INVENTION

It is known to provide a subsurface safety valve operated by solenoid coil. U.S. Pat. No. 3,731,742 discloses in one form a safety valve which is moved mechanically to the open position by a well tool and is locked in the open position by a detent. The valve is triggered to the closed position by actuating a solenoid for releasing the detent. U.S. Pat. No. 4,191,248 and U.S. Pat. No. Re. 30,110 disclosure subsurface solenoid actuated safety valves in which the solenoid mechanism performs the function of opening the valve and is fail-safe in that the valve will close in the event that electrical power is lost. However, these valves will undesirably close if various well forces overcome the power of the solenoid such as if the flow velocity through the well tubing increases or if well tools moving upwardly in the safety valve engage and cause the safety valve to close.

The present invention is directed to a failsafe subsurface well safety valve which is first opened by mechanically shifting a tubular member to open the safety valve, and secondly is locked in the open position by applying current to a solenoid coil which holds an armature to releasably lock the valve open. This has the advantage that the valve is positively locked open against forces in the well which might tend to close the valve and secondly allows the valve to be held open and in the locked position with a minimum of electrical energy.

SUMMARY

The present invention is directed to a solenoid operated well safety valve including a housing with a bore, a valve closure member in the bore moving between open and closed positions, and a tubular member telescopically movable in the housing for controlling the movement of the valve closure member. First biasing means act on the tubular member for moving the tubular member in a direction to close the valve. An armature is movable in the housing and a solenoid coil is connected to the housing for moving and/or holding the armature. Second biasing means acts on the armature for moving the armature upwardly. Releasable lock means is provided for locking the tubular member in the open position and the lock means includes means for releasably locking the tubular member to the housing. The locking means is held in the locked position by the armature when it is energized by the solenoid coil. The valve is closed when the solenoid coil is de-energized thereby releasing the lock means, and the first biasing means moves the tubular member for closing the valve.

A further object of the present invention is the provision of coacting engageable shoulders on the tubular member and the armature so that when the tubular member is moved downwardly the armature is moved downwardly for reducing the electrical current required for the solenoid coil. That is, the solenoid coil is not required to shift the armature but only is required to have a sufficient force to hold the valve open.

Another further object of the present invention is wherein the releasable lock means includes a movable dog carried by the housing and said tubular member includes a holding shoulder, and a locking shoulder is carried by the armature for locking the dog against the holding shoulder. Preferably the tubular member includes a holding notch above the holding shoulder.

Yet a still further object of the present invention is the provision of a solenoid operated fail-safe safety valve having a valve closure member in a bore in a housing with a tubular member telescopically movable in the housing for controlling the movement of the valve closure member. Means are provided on the tubular member for mechanically moving the tubular member downwardly to open the valve closure member, and first biasing means acts on the tubular member for moving the tubular member upwardly for allowing the valve closure member to close. An armature is movable in the housing and second biasing means acts on the armature for moving the armature upwardly. Engaging shoulders on the tubular member and the armature move the armature downwardly when the tubular member is moved downward. A solenoid coil connected to the housing acts on the armature for holding the armature downwardly when the solenoid is energized. Releasable locking means including a movable dog carried by the housing, and the tubular member includes a holding shoulder and a locking shoulder is carried by the armature for locking the dog against the holding shoulder for locking the tubular member in the open position to the housing. The locking means is held in the locked position by the armature in response to the solenoid coil.

Other and further objects, features and advantages will be apparent from the following description of a presently preferred embodiment of the invention, given for the purpose of disclosure and taken in conjunction with the accompanying drawings.

DESCRIPTION OF THE PREFERRED EMBODIMENT

Figures 1A, 1B:
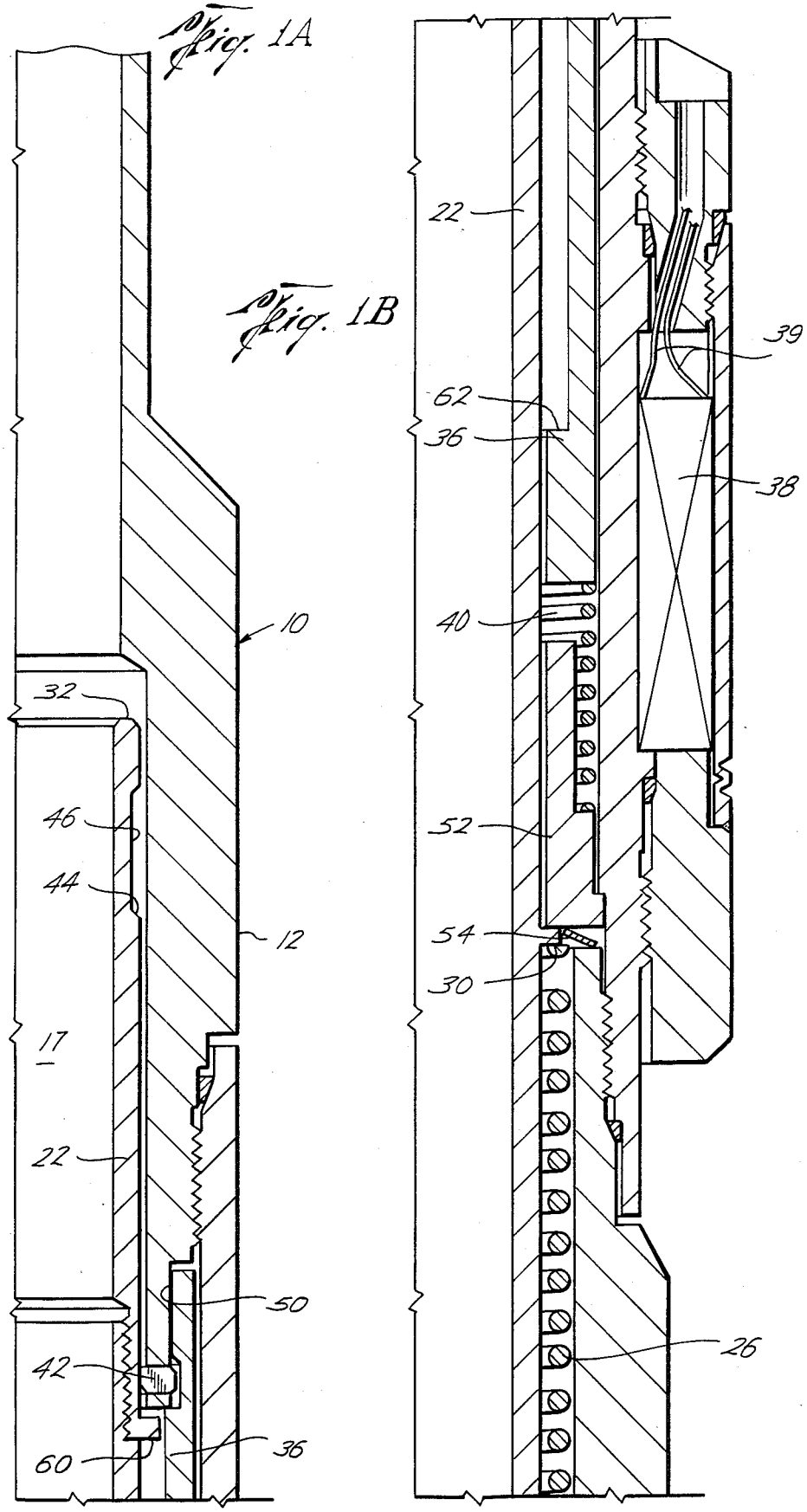
FIGS. 1A, 1B and 1C are continuations of each other and are a fragmentary elevation view in quarter section, of the safety valve of the present invention shown, in solid outline, in the closed position and shown, in the dotted outline, in the open position.

While the solenoid operated safety valve of the present invention will be described in connection with a tubing retrievable type valve using a flapper valve closure element, for purposes of illustration only, it is to be understood that the present invention is applicable to other types of safety valves and other safety valves utilizing other types of valve closure means.

Referring now to the drawings, the reference numeral 10 generally indicates the solenoid operated well safety valve of the present invention and includes a housing 12 which may have upper and lower threaded connections (not shown) for connecting the valve 10 into a well tubing. The housing 12 includes a bore 17 therein and a valve closure member 18 such as a flapper valve is positioned in the bore 17 and is connected to a pivot 20 for moving to a closed position as best seen in solid outline in FIG. 1C for blocking flow therethrough or moving to an open position as best seen in dotted outline in FIG. 1C for allowing flow through valve 10. A tubular member 22 is telescopically movable in the housing 12 for controlling the movement of the valve closure member 18. When the tubular member 22 is in the upward position, the flapper valve 18 is allowed to move to the closed position by a spring 24 and by the upward flow of well fluids through the bore 17. However, when the tubular member 22 is moved downwardly, it moves the flapper valve 18 off of its seat and thereby opens the valve 10.

Various forces are provided for controlling the movement of the tubular member 22. Thus, biasing means such as a spring 26 may be positioned in the housing 12 between a shoulder 28 in the housing and a shoulder 30 on the tubular member 22 for biasing the tubular member 22 upwardly in a directly to close the valve 10. In order to open the valve, means are provided on the tubular member 22 such as a shoulder 32 at the top or a suitable recess on the interior (not shown) for engagement by any suitable type of well tool for mechanically moving the tubular member 22 downwardly through the flapper valve 18 for opening the valve.

Figure 2:
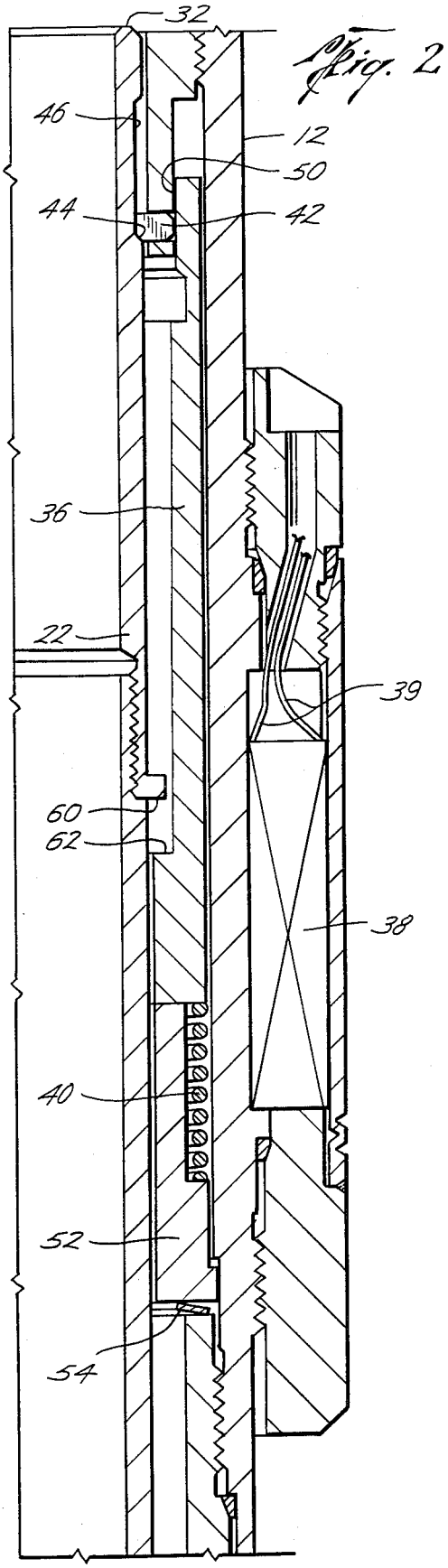
FIG. 2 is a fragmentary elevational view, in cross section, of the safety valve showing the tubular member locked in the open position and to the housing.

However, it is desirable to lock the tubular member 22 in the open position and lock it with respect to the housing 12 so that it will be unaffected by forces in the bore 17 causing the valve 10 to unintentionally close. Thus, a releasable lock means for locking the tubular member 22 in the open position and to the housing 12 is provided in which the locking means is held in the locked position by an armature energized by a solenoid coil. Thus, a magnetic armature 36 is provided which is telescopically movable in the housing and which is adapted to be attracted by a solenoid coil 38 and moved from an upward position, as best seen in FIG. 1B, to a downward position as best seen in FIG. 2. The armature 36 is biased upwardly by a second biasing means such as a spring 40. The releasable locking means also includes a movable dog 42 carried by the housing 12 for movement in a radial direction inwardly toward the tubular member 22 and outwardly from the tubular member 22. The tubular member 22 includes a holding shoulder 44 and preferably a holding notch 46 above the shoulder 44. Initially, with the valve 10 in the open position, the dog 42 is out of engagement with the notch 46 and shoulder 44. The armature 36 includes a locking shoulder 50 which, when the valve is in the open position, is out of engagement with the dog 42.

Figure 1C:
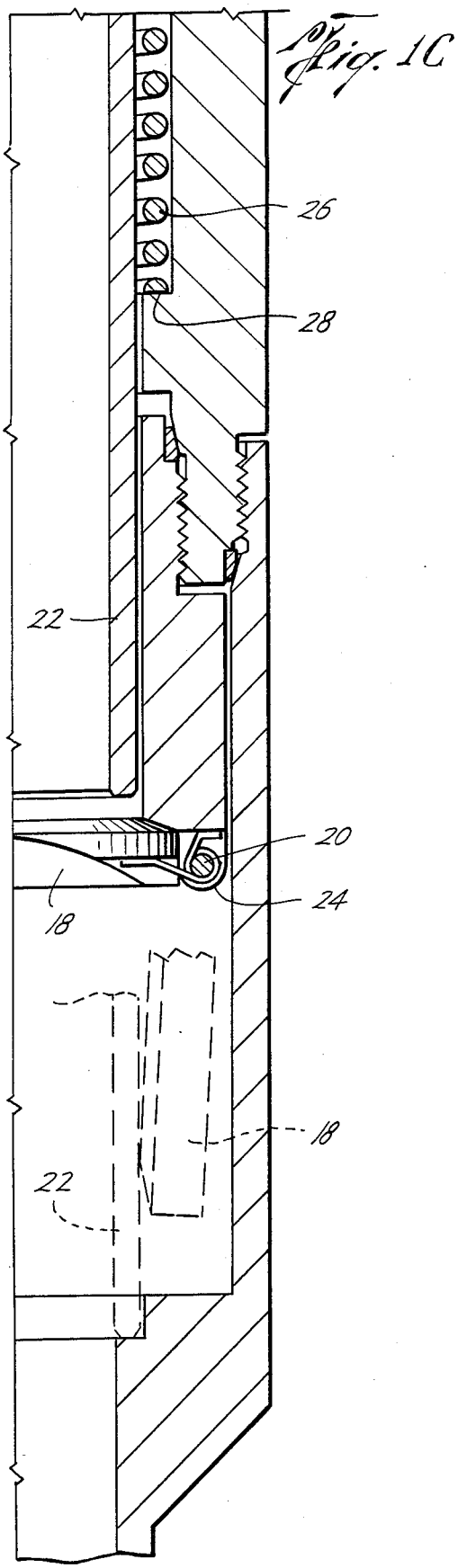

As best seen in FIG. 2, after the tubular member 22 has been moved downwardly to the open position to open the closure element valve 18, the notch 46 is brought into alignment with the locking dog 42. At this time, a current is produced in the solenoid coil 38 conducted through the electrical leads 39 which extend to the well surface for attracting the armature 36 downwardly to bring the locking shoulder 50 into engagement with the dog 42 thereby moving the dog 42 inwardly into the locking notch 46. Thereafter, the shifting tool (not shown) which moves the tubular member 22 downwardly may be removed, and the biasing spring 26 will move the tubular member 22 upwardly until the holding shoulder 44 engages the dog 42. Thereafter, the valve will be locked in the open position so long as the solenoid coil 38 is energized. The dog 42 locks the tubular member 22 to the housing 12 and any forces in the bore 17 such as upward flow of well fluid or upwardly moving well tools cannot accidently move the tubular member 22 by overcoming the solenoid force as in other solenoid type safety valves and accidently close the valve 10. In addition, the amount of power required by the solenoid 38 to maintain the armature 36 in the downward and locked position is considerably less than the amount of power required to open a conventional solenoid actuated safety valve. This reduces the expense of operation of the valve 10, reduces the coil temperature and increases its service life. However, the valve 10 is a fail-safe valve in that in the event that electrical power to the coil 38 is lost or shut off, the valve 10 will automatically return to the closed position. That is, when the electric current in the solenoid coil 38 ceases, the armature 36 will move upwardly by the action of its biasing spring 40 to move the locking shoulder 50 out of engagement with the dog 42 thereby allowing the dog 42 to move outwardly away from the tubular member 22 and the holding shoulder 44 and holding notch 46. Biasing spring 26 will then move the unlocked tubular member 22 upwardly to its open position as best seen in FIGS. 1A, 1B and 1C thereby allowing the valve closure element 18 to close and seat.

In addition, a magnetic stop 52 may be provided which is positioned in the housing 12 and in alignment with the armature 36 for reducing the amount of electrical power required by the coil 38 to hold the armature 36 in the downward position. The magnetic stop 52 is biased by spring 54 such as a Bellville washer-type spring for providing a shock absorber.

While the above structure and operation is satisfactory, the preferred embodiment includes coacting engageable shoulders 60 and 62 on the tubular member 22 and armature 36, respectively, which are engaged when the tubular member 22 is shifted downwardly. That is, when the tubular member 22 is mechanically shifted downwardly, it will engage the armature 36 and move the armature 36 downwardly against the magnetic stop 52 and will move the shoulder 50 into engagement with the dog 42 thereby moving the dog 42 into locking notch 46. Therefore, a high current is not required to be applied to the coil 38 to shift the armature 36 and the releasable lock means. Instead with the armature moved downwardly mechanically, a low electrical current in the coil 38 is sufficient to maintain the armature 36 against the magnetic stop 52 which also maintains the shoulder 50 in engagement with the dog 42. Therefore, the use of the shoulders 60 and 62 provides a valve which is held open by a low holding current and does not require a high current and additional controls to open the valve.

The safety valve 10 is a subsurface fail-safe solenoid operated safety valve which provides a locking mechanism which will hold the tubular member 22 in the open position locked to the housing 12 regardless of axial forces applied to the tubular member 22 such as the production flow rate through the bore 17 or a wire line tool passing through the valve 10.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will readily suggest themselves to those skilled in the art and which are emcompassed with the spirit of the invention and the scope of the appended claims.

What is claimed is:

1. A solenoid operated well safety valve comprising, a housing having a bore, a valve closure member in the bore moving between open and closed positions, a tubular member telescopically movable in the housing for controlling the movement of the valve closure member, first biasing means acting on said tubular member for moving the tubular member in a direction to close said valve, an armature movable in the housing, a solenoid coil adjacent to the housing for moving the armature, second biasing means acting on the armature for moving the armature upwardly, and releasable lock means for locking the tubular member in the open position, said lock means includes means for releasably locking the tubular member to the housing in which the locking means is held in the locked position by the armature in response to the solenoid coil.

2. The apparatus of claim 1 wherein the releasable lock means includes, a movable dog carried by the housing, and said tubular member includes a holding shoulder, and a locking shoulder carried by the armature for locking the dog against the holding shoulder.

3. The apparatus of claim 1 including, coacting engageable shoulders on the tubular member and the armature whereby the armature is moved downwardly by the tubular member for reducing the electrical current required for the solenoid coil.

4. A solenoid operated well safety valve comprising, a housing having a bore, a valve closure member in the bore moving between open and closed positions, a tubular member telescopically movable in the housing for controlling the movement of the valve closure member, means on the tubular member for mechanically moving said tubular member downwardly to open the valve closure member, first biasing means acting on said tubular member for moving the tubular member upwardly for allowing the valve closure member to close, an armature movable in the housing, second biasing means acting on the armature for moving the armature upwardly, a solenoid coil adjacent to the housing for moving the armature downwardly when the solenoid is energized, coacting engageable shoulders on the tubular member and the armature whereby the armature is moved downwardly by the tubular member for reducing the electrical current required for the solenoid coil, and releasable lock means for locking the tubular member in the open position, said lock means includes means for releasably locking the tubular member to the housing in which the locking means is held in the locked position by the armature in response to the solenoid coil.

5. The apparatus of claim 4 wherein the releasable lock means includes, a movable dog carried by the housing, and said tubular member includes a holding shoulder, and a locking shoulder carried by the armature for locking said dog against the holding shoulder.

6. The apparatus of claim 5 wherein the tubular member includes a holding notch above the holding shoulder.

* * * * *